United States Patent [19]

Wilsberg et al.

[11] Patent Number: 4,610,799

[45] Date of Patent: Sep. 9, 1986

[54] WASHING ADDITIVE IN PASTE FORM CONTAINING AN ACTIVATOR FOR PER COMPOUNDS, AND PACKAGE THEREFOR

[75] Inventors: Heinz-Manfred Wilsberg, Cologne; Rolf Puchta, Haan; Klaus Koester, Langenfeld; Franz-Josef Carduck, Haan, all of Fed. Rep. of Germany

[73] Assignee: Henkel Kommanditgesellschaft auf Aktien, Duesseldorf, Fed. Rep. of Germany

[21] Appl. No.: 725,842

[22] Filed: Apr. 22, 1985

[30] Foreign Application Priority Data

Apr. 28, 1984 [DE] Fed. Rep. of Germany ..... 3415880

[51] Int. Cl.[4] ..... C11D 3/32; C11D 3/39; C11D 17/00; C11D 17/08

[52] U.S. Cl. ..... 252/90; 252/93; 252/102; 252/104; 252/153; 252/154; 252/173; 252/174.17; 252/174.21; 252/174.22; 252/174.25; 252/182; 252/186.38; 252/544

[58] Field of Search ..... 252/90, 102, 104, 153, 252/154, 174.21, 182, 186.38, 544, 173, DIG. 14

[56] References Cited

U.S. PATENT DOCUMENTS

| | | | |
|---|---|---|---|
| 4,107,360 | 8/1978 | Schmidgall | 427/389 |
| 4,179,390 | 12/1979 | Spadini et al. | 252/95 |
| 4,188,304 | 2/1980 | Clarke | 252/93 |
| 4,220,562 | 9/1980 | Spadini | 252/542 |
| 4,248,928 | 2/1981 | Spadini | 428/286 |
| 4,289,815 | 9/1981 | Lee | 428/35 |
| 4,348,293 | 9/1982 | Clarke | 252/90 |
| 4,356,099 | 10/1982 | Davies | 252/90 |
| 4,391,724 | 7/1983 | Bacon | 252/90 |
| 4,410,441 | 10/1983 | Davies | 252/92 |
| 4,416,791 | 11/1983 | Haq | 252/90 |
| 4,428,789 | 1/1984 | Morris | 8/137 |

FOREIGN PATENT DOCUMENTS

| | | |
|---|---|---|
| 0000226 | 1/1979 | European Pat. Off. . |
| 0079712 | 5/1983 | European Pat. Off. . |
| 0106634 | 4/1984 | European Pat. Off. . |
| 2744642 | 4/1978 | Fed. Rep. of Germany . |
| 2857153 | 1/1980 | Fed. Rep. of Germany . |

*Primary Examiner*—Dennis L. Albrecht

*Attorney, Agent, or Firm*—Ernest G. Szoke; Henry E. Millson, Jr.

[57] ABSTRACT

A washing additive consisting of a bag, filled with a detergent composition, of a polyvinyl-alcohol-based film readily soluble in borate-containing aqueous solutions. The detergent composition is a mixture of a nonionic surfactant, a quaternary ammonium compound containing a long-chain radical, which may be completely or partly replaced by a fatty amine ethoxylate or by a $\beta$-aminoalkyl propionic acid derivative, an activator for per compound, an antigel agent, and a viscosity regulator, wherein the mixture has a viscosity of from 1000 to 100,000 mPas for a shear gradient of from 5 to 500 $s^{-1}$.

19 Claims, No Drawings

WASHING ADDITIVE IN PASTE FORM CONTAINING AN ACTIVATOR FOR PER COMPOUNDS, AND PACKAGE THEREFOR

BACKGROUND OF THE INVENTION

1. Field of the Invention

This invention relates to washing additives which can be added to wash liquors to increase their detergent effect. The addition of the additives of the invention improves the removal of bleachable stains and of fat-, oil- and pigment-containing soil from fabrics to be washed.

2. Description of Related Art

In the washing of fabrics, the wash liquor is generally heated to a temperature considerably beyond room temperature. This measure increases the detergent effect of the detergents used; in some cases, to a considerable extent. However, the heating of the wash liquor and of the fabrics involves increased energy consumption during washing. Since, in addition, certain fabrics, particularly fabrics of wool or synthetic fibers, cannot be washed at elevated temperatures for various reasons, attempts have repeatedly been made to obtain good washing results at low temperatures. At low washing temperatures, however, the effect of the per compounds, frequently used for removing bleachable stains, is reduced; in some cases considerably, or even weakened to such an extent that stains cannot be removed. For this reason, so-called bleach activators are added to detergents to increase their bleaching effect, intensifying the bleaching effect of the per compounds and allowing them to be developed even at low washing temperatures. However, the simultaneous presence of per compounds and bleach activators in detergents reduces their stability in storage, particularly if the materials cannot be protected against moisture during storage. Attempts to improve stability generally resulted in a considerable reduction in the bleaching effect of the detergents. Because of this, it has already been proposed to store the bleach activator separately from the detergent containing the per compound and to add at least part of the activator to the wash liquor just before it is used. With a view to solving this problem, German Application No. 27 44 642 proposes a detergent additive which contains an organic bleach activator in water-releasable combination with a non-particulate substrate. In addition to the bleach activator and optional release aids, the detergent additive according to German Application No. 27 44 642 may contain further additives such as, for example, foam modifiers, chelating agents, soil suspending agents, optical brighteners, bactericides, anti-clouding agents, enzymes, fabric softeners and fragrances. By separating the bleach activator and the bleaching per compound from one another until just before use, it is possible to avoid the problems that arise when per compounds and bleach activators are stored together. A further improvement in the detergency of detergents based on anionic surfactants and inorganic per salts can be obtained by using the additive of German Application No. 28 57 153, which, in addition to a bleach activator, contain on a substrate a combination of an alkoxylated nonionic surfactant and a cationic surfactant containing a $C_8$–$C_{20}$-radical and, for the rest, $C_1$–$C_4$-radicals. However, one disadvantage of this known additive lies in the fact that, on removing the additive from its pack and adding it to the wash liquor, the user comes into contact with the active constituents which, apart from—in some cases—an unpleasant feeling, can cause skin irritation. Another disadvantage of this known additive is that, after washing, the water-insoluble substrate has to be disentangled from the washed fabrics.

DESCRIPTION OF THE INVENTION

Accordingly, an object of the present invention is to provide a washing additive for increasing the detergent effect of detergents wherein the user does not come into contact with the active constituents of the additive and wherein the substrate does not have to be sorted out from the washed fabrics after washing. The washing additives of the invention comprise:

(A) a detergent composition, and (B) a bag-like structure surrounding (A) of a polyvinyl-alcohol-based film readily soluble in borate-containing aqueous solutions.

The detergent compositions (A) of the invention are present in water-soluble bags (B) in thickly liquid to pasty mixtures of the following active components:

(a) from about 2 to about 30 parts by weight of at least one nonionic surfactant, (b) from about 0.5 to about 10 parts by weight of at least one of (i) a quaternary ammonium compound containing a long-chain $C_{10}$–$C_{20}$ alkyl or alkenyl group and three $C_1$–$C_4$ alkyl groups, (ii) a fatty amine derivative which is an adduct of 1 to 6 moles of ethylene oxide with 1 mole of a primary fatty amine having a long-chain $C_{10}$–$C_{18}$ alkyl or alkenyl group, and (iii) a compound corresponding to the formula $R—NH—CH_2—CH_2—COONa$, in which R is an alkyl or alkenyl group containing from 10 to 18 carbon atoms, preferably 14 carbon atoms, (c) from about 2 to about 30 parts by weight of at least one activator for per compounds, (d) from about 2 to about 50 parts by weight of at least one antigel agent which is a polyhydric alcohol, (e) from about 5 to about 20 parts by weight of at least one viscosity regulator in an amount sufficient to give the composition a viscosity of from about 1000 to about 100,000 mPas for a shear gradient of from 5 to 500 $s^{-1}$, (f) from 0 to about 5 parts by weight of at least one heavy metal complexing agent, and, optionally, (g) balance foam regulators and/or dyes in small quantities, e.g. from about 0.01 to about 3 parts by weight.

The nonionic surfactants used as component (a) are adducts of ethylene oxide with fatty alcohols or, preferably oxoalcohols, containing from 12 to 18 and preferably from 14 to 15 carbon atoms. The best effects are obtained with oxoalcohol ethoxylates containing from 3 to 10, preferably from 6 to 8 and, more preferably, approximately 7 moles of ethylene oxide per mole of alcohol. The presence of nonionic surfactants in the washing additives of the invention promotes the removal of greasy and oily stains during washing.

The improvement in the removal of pigment-containing soil from fabrics is achieved by the presence in the additive of the invention of component (b) above, i.e., one or more of (i) certain quaternary ammonium compounds, (ii) ethylene oxide adducts of primary fatty amines, and (iii) $\beta$-aminoalkyl (or alkenyl)-propionic acid salts corresponding to the formula R—NH—$CH_2$—$CH_2$—COONa where R is a $C_{10}$–$C_{18}$ alkyl or alkenyl group. As stated above, suitable quaternary ammonium compounds (i) contain a long chain $C_{10}$–$C_{20}$-alkyl or alkenyl group , preferably a $C_{10}$–$C_{16}$-alkyl group; and more preferably an alkyl group containing 14 carbon atoms. For the three remaining groups on the quaternary ammonium compound, these groups are identical or different $C_1$–$C_4$-alkyl groups, preferably methyl groups. One particularly suitable and therefore preferred quaternary ammonium compound is tetradecyl trimethylammonium bromide or chloride. The quaternary ammonium compound can be completely or partly replaced by the fatty amine ethoxylate (ii). One example of a particularly suitable fatty amine ethoxylate is the adduct of 2 moles of ethylene oxide with primary cocoalkyl amine. Accordingly, this product is also preferred for use herein.

With respect to component (c), N-acyl and 0-acyl compounds are suitable activators for per compounds. Acetyl compounds have proved to be particularly effective. Examples of acetyl compounds are tetraacetyl glycol uril, pentaacetyl glucose and, in particular, tetraacetyl ethylene diamine. In conjunction with the per compounds used in standard heavy-duty detergents and particularly in conjunction with the perborate normally used, these bleach activators lead to an improvement in the removal of bleachable fabric stains.

The antigel agents (component (d)) are polyhydric alcohols which are capable of preventing the well-known gelation of the nonionic surfactant on contact with water. Preferred antigel agents are polyhydric alcohols containing from 2 to 4 carbon atoms which are thoroughly mixed with the nonionic surfactant. The antigel effect of the polyhydric alcohol can be intensified by using a mixture of a polyhydric alcohol and condensation products of $C_{10}$–$C_{20}$-fatty alcohols with 1 to 4 moles of ethylene oxide per mole of fatty alcohol instead of the polyhydric alcohol alone. Polyhydric alcohols suitable for use as antigel agents are, for example, 1,2-propylene glycol, ethylene glycol or glycerine or mixtures of these alcohols. One example of a particularly suitable fatty alcohol ethoxylate which may be used in admixture with the polyhydric alcohol to intensify the antigel effect is tallow alcohol ethoxylate with 2 moles of ethylene oxide. However, a $C_{12}$–$C_{14}$ fatty alcohol ethoxylate with 3 moles of ethylene oxide, which contains approximately 70% of C12 fatty alcohol ethoxylate, is also suitable for use as the antigel agent. If a polyhydric alcohol is used alone as the antigel agent, a favorable antigel effect is obtained if the ratio by weight of nonionic surfactant to polyhydric alcohol is in the range from about 1:1 to about 1:2. If, instead, a mixture of a polyhydric alcohol and a fatty alcohol ethoxylate is used, very good results are obtained if the ratio by weight of nonionic surfactant to polyhydric alcohol to fatty alcohol ethoxylate is in the range of from about (7 to 12):(5 to 16):(0.5 to 4). The antigel effect of the antigel agent can be further increased by using compounds readily soluble in water, particularly sodium borate, sodium chloride, sodium sulfate, sodium acetate or even sugars, in addition to the antigel agents described above.

Component (e) is employed to give the contents of the bag a viscosity of from about 1000 to about 100,000 mPas to ensure effective dissolution. A viscosity in the above-mentioned range can be obtained by using any of a number of different additives acting as viscosity regulators, including for example water-insoluble zeolites, particularly of the zeolite A type, highly disperse silica, layer silicates, particularly swellable layer silicates of the bentonite and hectorite type, and also water-soluble salts as well as sugars, polyglycols or fatty alcohol ethoxylates containing a high proportion of ethylene oxide. In the context of the invention, a high proportion of ethylene oxide in fatty alcohol ethoxylates means that the fatty alcohol ethoxylate contains from about 15 to about 25 moles of ethylene oxide per mole of fatty alcohol.

The washing additive preferably contains as component (f) small quantities of chelating agents for complexing troublesome heavy metal ions. Particularly suitable chelating agents are water-soluble salts of alkane polyphosphonic acids such as phosphonoalkane polycarboxylic acids and amino- and hydroxy-substituted alkane polyphosphonic acids, more especially the alkali salts of amino-tris-(methylenephosphonic acid), dimethyleneaminomethanediphosphonic acids, 1-hydroxyethane-1,1-diphosphonic acid, 1-phosphonoethane-1,2-dicarboxylic acid, 2-phosphonobutane-1,2,3-tricarboxylic acid and, in particular, the hexasodium salt of ethylene diamine tetramethylene phosphonic acid. It is also preferable to add foam regulators (component (g)); foam formation generally has to be inhibited. Suitable foam inhibitors are, for example, the known silicone oils.

The detergent composition (A) is surrounded by a bag (B) of water-soluble film based on polyvinyl alcohol. To ensure that the bag dissolves quickly and completely in the washing machine during the washing process, particularly where it is carried out with a short liquor ratio (=ratio of washing to water), the constituent material of the bag has to satisfy particular requirements. A polyvinyl alcohol film which satisfies those requirements is the subject of European Patent Application No. 79 712. According to the teaching of this application, which is incorporated herein by reference, films of polyvinyl alcohol dissolve quickly and completely in borate-containing wash liquors provided that the polyvinyl alcohol has a molecular weight below about 50,000 and/or provided that the polyvinyl alcohol contains a polyhydroxy compound having a certain binding constant with borate, and/or provided that the polyvinyl alcohol contains an acid having a stated dissociation constant. The need for rapid dissolution in borate-containing wash liquors is attributable to the perborate normally used as the bleaching component of detergents.

A film which dissolves satisfactorily is polyvinyl alcohol having a molecular weight of approximately 10,000. The polyvinyl alcohol is hydrolyzed to a level of about 88% and makes up about 71% by weight of the film. The film additionally contains glycerine, trimethylol propane, sorbitol and water in small quantities.

The washing additive of the invention is produced for example by heating the nonionic surfactant and mixing it with the foam inhibitor. The antigel agent and, optionally, the complexing agent are mixed into the resulting heated mixture. The powder-form viscosity regulators are then suspended using intensive mixing elements and the suspension formed is cooled. A paste is obtained and is introduced into a bag in a quantity sufficient to increase the detergent effect of standard commercially available detergents. The bag is sealed either by heat sealing or by moistening the edges with water, pressing them together and allowing them to dry.

The present invention also relates to a process for producing the washing additive. This process is carried out by heating the nonionic surfactant component (a) and, optionally, the foam regulator (g) to 40°–75° C.; the antigel (d) and, optionally, the complexing agent (f) are then mixed in, the activator for per compounds (c), the quaternary ammonium compound and/or the amine derivative and/or the compound corresponding to the formula R—NH—$CH_2$—$CH_2$—COONa, (component (b)) together with the viscosity regulator (e) are suspended in the premix under the effect of intense shear forces. The resulting suspension is cooled to room temperature and then introduced into a bag-like structure (B) of a polyvinyl-alcohol-based film readily soluble in borate-containing aqueous solutions.

The invention will be illustrated but not limited by the following examples.

EXAMPLES

Examples 1 to 5 below describe the composition and production of washing additives of the invention.

EXAMPLE 1

1.35 Kg of $C_{14}$–$C_{15}$-oxoalcohol+7 moles of ethylene oxide were mixed while heating with 0.077 Kg of foam-inhibiting silicone oil. 0.483 Kg of 1,2-propylene glycol, 0.483 Kg of glycerine and 0.133 Kg of oleyl/cetyl alcohol+2 moles of ethylene oxide were added to the resulting mixture, followed by heating to 60° C. After homogenization, 0.720 Kg of polyethylene glycol (molecular weight approx. 4000) were added in solid form and melted in the mixture. 0.315 Kg of the hexasodium salt of ethylene diamine tetramethylene phosphonate was then added in the form of a 50% by weight aqueous solution. 0.483 Kg of tetraacetyl trimethylammonium bromide, 1.253 Kg of tetraacetyl ethylene diamine, 0.238 Kg of highly disperse silica and 1.463 Kg of sodium sulfate were then suspended in the liquid mixture obtained by means of a dissolver disc and the resulting suspension wet-ground in a toothed colloid mill. After cooling to 30°–35° C., a paste having a density of 1.29 g/cc and a viscosity (according to DIN 114, Contraves rotational vicosimeter) of 65,000 mPas (shear gradient $D=5.6\ s^{-1}$) or 6200 mPas ($D=500\ s^{-1}$) was obtained.

35.9 g of this paste were introduced into a bag (edge length 7.5×7.5 cm) of a 65 μm thick film of 71% by weight of polyvinyl alcohol (molecular weight approx. 10,000, degree of hydrolysis 88%, 6% by weight of glycerine, 6% by weight of trimethylol propane, 7.5% by weight of sorbitol, balance water). The bag was sealed by heat sealing.

Bags thus produced were used for determining dissolving behavior and the increase in detergency.

To test dissolving behavior, a bag was introduced with fabrics into an automatic washing machine (Miele De Luxe W 433), washed at 30° C. and inspected after washing for 5, 10 and 15 minutes to ascertain whether any residues of the washing additive were present on those parts of the washing machine which come into contact with the wash liquor and whether there were any remains of the washing additive in the washing. This test was repeated 25 times. In 19 of the tests, there were no residues to be seen after only 5 minutes; after another 5 minutes, no residues were visible in 24 of the tests and, after a total of 15 minutes, the washing additives were completely dissolved in every test. In the absence of antigel agents or antigel agents which do not correspond to the invention, residues of the bag contents or even the entire contents of the bags were noticeable on the washing machine and/or in the washing. The washing additive of the invention dissolved even more quickly at water temperatures higher than 30° C.

To test the improvement in detergency provided by the washing additives of the invention, test fabrics stained with pigment soil, oil/grease and bleachable stains were washed for 30 minutes at 60° C. in an automatic washing machine (Miele De Luxe W 433) together with 3 Kg of clean washing and the washing additive of Example 1. The detergent used was an inexpensive detergent in two thirds the prescribed dosage. A very distinct removal of the stains was observed, corresponding to that obtained with a standard commercially available detergent-boosting cloth which carried the active components on its surface and which, after washing, had to be disentangled from the washing.

EXAMPLE 2

A paste of active constituents was prepared as in Example 1, additionally containing 0.720 Kg of sorbitol, but no highly disperse silica or sodium sulfate. The wet-grinding step described in Example 1 was omitted in this Example 2. After cooling to 27° C., the paste had a viscosity of 80,000 mPas ($D=5.6\ s^{-1}$) which could be reduced to lower levels by applying shear forces. The dissolving behavior and the effect in boosting detergency of the paste sealed in a bag as in Example 1 corresponded to the product of Example 1.

EXAMPLE 3

A paste corresponding to Example 1 which, instead of the polyethylene glycol and the highly disperse silica, contained the same quantity (i.e. 0.958 Kg) of magnesium aluminum silicate (Veegum HV®) was similar in its behavior to the paste of Example 1.

EXAMPLE 4

A paste prepared in the same way as in Example 1 except that it contained 480 g of cetyl stearyl alcohol instead of polyethylene glycol and was degassed at 50 Torr before bagging, had a consistency which, in contrast to the paste of Example 1, was largely unaffected by the shearing conditions.

EXAMPLE 5

A consistency largely unaffected by the shearing conditions was also shown by a paste corresponding to Example 1 in which half the polyethylene glycol was replaced by cetyl stearyl alcohol.

EXAMPLE 6

Example 6 is an example of a paste which does not correspond to the invention. When a paste was prepared solely from the nonionic surfactant, the quaternary ammonium compound, the activator for per compounds, the complexing agent and the foam regulator of Example 1, in the same quantities set forth therein, the paste thus prepared gelled into a lump on contact with water and, even after 15 minutes, had still not dissolved in the wash liquor.

What is claimed is:

1. A detergent paste composition comprising:

(a) from about 2 to about 30 parts by weight of at least one nonionic surfactant which is an adduct of ethylene oxide with a fatty alcohol or an oxoalcohol wherein the fatty alcohol or oxoalcohol contains from 12 to 18 carbon atoms and the adduct contains from 3 to 10 moles of ethylene oxide per mole of alcohol, (b) from about 0.5 to about 10 parts by weight of at least one of:

(i) a quaternary ammonium compound containing a long-chain $C_{10}$–$C_{20}$ alkyl or alkenyl group and three $C_1$–$C_4$ alkyl groups, (ii) a fatty amine derivative which is an adduct of 1 to 6 moles of ethylene oxide with 1 mole of a primary fatty amine having a long-chain $C_{10}$–$C_{18}$ alkyl or alkenyl group, (iii) a compound of the formula R—NH—$CH_2$—$CH_2$—COONa where R is a $C_{10}$ ∝ $C_{18}$ alkyl or alkenyl group, (c) from about 2 to about 30 parts by weight of at least one actinator for per compounds, (d) from about 2 to about 50 parts by weight of at least one polyhydric alcohol antigel agent, (e) from about 5 to about 20 parts by weight of at least one viscosity regulator in an amount sufficient to give the detergent composition a viscosity of from about 1000 to about 100,000 mPas, wherein the at least one viscosity regulator is selected from the group consisting of water insoluble zeolites, highly dispersed silica, layer silicates, water-soluble salts, sugars, polyglycols, and fatty alcohol ethoxylates containing at least about 15 moles of ethylene oxide per mole of fatty alcohol, (f) from 0 to about 5 parts by weight of at least one heavy metal complexing agent, and, optionally, (g) a small quantity of a foam regulator, a dye, or both.

2. A washing additive comprising:

A. a detergent paste composition, and

B. a bag-like structure surrounding the detergent composition wherein the bag-like structure is a polyvinyl alcohol-based film readily soluble in borate-containing aqueous solutions, and wherein the detergent composition contains.

(a) from about 2 to about 30 parts by weight of at least one nonionic surfactant which is an adduct of ethylene oxide with a fatty alcohol or an oxoalcohol wherein the fatty alochol or oxoalcohol contains from 12 to 18 carbon atoms and the adduct contains from 3 to 10 moles of ethylene oxide per mole of alcohol, (b) from about 0.5 to about 10 parts by weight of at least one of:

(i) a quaternary ammonium compound containing a long-chain $C_{10}$–$C_{20}$ alkyl or alkenyl group and three $C_1$–$C_4$ alkyl groups, (ii) a fatty amine derivative which is an adduct of 1 to 6 moles of ethylene oxide with 1 mole of a primary fatty amine having a long-chain $C_{10}$–$C_{18}$ alkyl or alkenyl group, (iii) a compound of the formula R—NH—$CH_2$—$CH_2$—COONa where R is a $C_{10}$–$C_{18}$ alkyl or alkenyl group, (c) from about 2 to about 30 parts by weight of at least one activator for per compounds, (d) from about 2 to about 50 parts by weight of at least one polyhydric alcohol antigel agent, (e) from about 5 to about 20 parts by weight of at least one viscosity regulator in an amount sufficient to give the detergent composition a viscosity of from about 1000 to about 100,000 mPas, wherein the at least one viscosity regulator is selected from the group consisting of water insoluble zeolites, highly dispersed silica, layer silicates, water-soluble salts, sugars, polyglycols, and fatty alcohol ethoxylates containing at least about 15 moles of ethylene oxide per mole of fatty alcohol, (f) from 0 to about 5 parts by weight of at least one heavy metal complexing agent, and optionally, (g) a small quantity of a foam regulator, a dye, or both.

3. The washing additive of claim 2 wherein component (d) is a polyhydric $C_2$–$C_4$ alcohol.

4. The washing additive of claim 2 wherein in component (b) (iii) the R group is a $C_{14}$ group.

5. The washing additive of claim 2 wherein component (d) is a mixture of a polyhydric alcohol and a condensation product of a $C_{10}$–$C_{20}$ fatty alcohol with from 1 to 4 moles of ethylene oxide per mole of fatty alcohol.

6. The washing additive of claim 2 wherein the ratio by weight of component (a) to component (d) is in the range of from about 1:1 to about 1:2.

7. The washing additive of claim 5 wherein the ratio by weight of component (a) to polyhydric alcohol to condensation product is in the range of from about (7 to 12):(5 to 16):(0.5 to 4).

8. The washing additive of claim 2 wherein the detergent composition also contains at least one compound readily soluble in water selected from the group consisting of sodium borate, sodium chloride, sodium acetate, and a sugar.

9. The washing additive of claim 2 wherein component (e) is at least one substance insoluble in water selected from the group consisting of zeolite A, a highly disperse silica, and a layer silicate.

10. The washing additive of claim 2 wherein the detergent composition also contains a compound selected from the group consisting of a polyglycol and an adduct of from 15 to 25 moles of ethylene oxide with 1 mole of a fatty alcohol.

11. The washing additive of claim 2 wherein component (a) is an oxoalcohol ethoxylate wherein the oxoalcohol contains from 12 to 18 carbon atoms and from 3 to 10 moles of ethylene oxide per mole of oxoalcohol are present therein.

12. The washing additive of claim 2 wherein in component (b) (i) the long chain alkyl or alkenyl group contains from 10 to 16 carbon atoms.

13. The washing additive of claim 12 wherein the long chain alkyl or alkenyl group contains 14 carbon atoms.

14. The washing additive of claim 12 wherein component (b) (i) is tetradecyl trimethylammonium bromide.

15. The washing additive of claim 2 wherein component (c) is an N-acyl or O-acyl compound.

16. The washing additive of claim 15 wherein component (c) is selected from the group consisting of tetraacetyl glycol uril, pentaacetyl glucose, and tetraacetyl ethylene diamine.

17. The washing additive of claim 2 wherein component (f) is at least one water-soluble salt of an alkane polyphosphonic acid.

18. The washing additive of claim 17 wherein the alkane polyphosphonic acid is a phosphonoalkane polycarboxylic acid, an amino-substituted alkane polyphosphonic acid, or a hydroxy-substituted alkane polyphosphonic acid.

19. A process for the preparation of the washing additive of claim 2 comprising the steps of:

I. heating component (a), and optional component (g) if present, to a temperature of from about 40° to about 75° C., II. adding thereto component (d), and component (f) if present, III. adding to the mixture produced in II under intense shear forces components (c), (b), and (e), to form a suspension, IV. cooling the suspension to room temperature, and V. introducing the cooled suspension into bag-like structure B.

* * * * *